United States Patent [19]

Mizoguchi et al.

[11] Patent Number: 4,935,075

[45] Date of Patent: Jun. 19, 1990

[54] PERMANENT MAGNET

[75] Inventors: Tetsuhiko Mizoguchi; Isao Sakai, both of Yokohama; Hiromi Niu, Tokyo; Koichiro Inomata, Yokohama; Akihiko Tsutai, Kawasaki, all of Japan

[73] Assignee: Kabushiki Kaisha Toshiba, Kawasaki, Japan

[21] Appl. No.: 311,389

[22] Filed: Feb. 16, 1989

Related U.S. Application Data

[63] Continuation of Ser. No. 24,061, Mar. 10, 1987, abandoned, which is a continuation-in-part of Ser. No. 905,397, Sep. 10, 1986, abandoned.

[30] Foreign Application Priority Data

| | | | |
|---|---|---|---|
| Jun. 12, 1986 | [JP] | Japan | 61-134781 |
| Jun. 12, 1986 | [JP] | Japan | 61-134783 |
| Jul. 11, 1986 | [JP] | Japan | 61-161956 |

[51] Int. Cl.[5] ..... H01F 1/04

[52] U.S. Cl. ..... 148/302; 420/83; 420/121

[58] Field of Search ..... 148/302; 420/83, 121

[56] References Cited

U.S. PATENT DOCUMENTS

| | | | |
|---|---|---|---|
| 4,533,408 | 8/1985 | Koon | 148/103 |
| 4,664,724 | 5/1987 | Mizoguchi et al. | 148/302 |

FOREIGN PATENT DOCUMENTS

| | | | |
|---|---|---|---|
| 0101552 | 2/1984 | European Pat. Off. . | |
| 0106948 | 5/1984 | European Pat. Off. | 148/302 |
| 0108474 | 5/1984 | European Pat. Off. . | |
| 0125752 | 11/1984 | European Pat. Off. . | |
| 60-224755 | 11/1985 | Japan . | |
| 60-224756 | 11/1985 | Japan . | |
| 60-224757 | 11/1985 | Japan . | |
| 60-224761 | 11/1985 | Japan . | |
| 60-238447 | 11/1985 | Japan . | |
| 60-238448 | 11/1985 | Japan . | |

*Primary Examiner*—John P. Sheehan

*Attorney, Agent, or Firm*—Cushman, Darby & Cushman

[57] ABSTRACT

A permanent magnet essentially consists of 10 to 40% by weight of R, 0.1 to 8% by weight of boron, 13% by weight or less of gallium and iron, where R is at least one component selected from the group consisting of yttrium and the rare-earth elements.

The magnet having this composition has a high coercive force iHC and a high residual magnetic flux density and therefore has a high maximum energy product.

11 Claims, 6 Drawing Sheets

PERMANENT MAGNET

RELATED APPLICATIONS

This is a continuation of application No. 024,061, filed Mar. 10, 1987, which was abandoned upon the filing hereof, which in turn is a continuation-in-part of U.S. patent application 905,397 filed Sept. 10, 1986, now abandoned.

BACKGROUND OF THE INVENTION

The present invention relates to a rare earth-iron-based permanent magnet which includes a rare earth element, boron, and iron as its principal constituents.

In the past, a rare earth-Co-based magnet is known as a high performance magnet. Since, however, the maximum energy product $(BH)_{max}$ of the rare earth-Co-based magnet is not large enough, being about 30 mGOe at most, the strong demand in recent years for smaller size and higher performance in electronic apparatus, makes it desirable to develop a permanent magnet with higher performance. In response to such a demand, development has been ongoing for a permanent magnet that has iron as its principal constituent (See, for example, European Patent Application 101552, U.S. Pat. Nos. 4,402,770, 4533408, 4541877, and others). The iron-based permanent magnet includes a rare-earth element (R) such as Nd, and boron (B) with the balance occupied essentially by iron (Fe). It makes use of Fe which is less expensive than Co as the principal ingredient, and is capable of producing $(BH)_{max}$ that can exceed 30 mGOe. Therefore, it represents an extremely promising material that can provide a high performance magnet at low cost.

The drawback of the iron-based permanent magnet is that the Curie temperature (Tc) is low compared with the permanent magnet of rare earth-Co-based permanent magnet, and has an inferior temperature characteristics of the magnetic characteristics. This will become a serious problem when it is to be used for a DC brushless motor or the like that is operated under conditions such as high temperature environment, and hence an improvement on this aspect has been desired.

As such an improvement, there has been proposed a composition such as R—B—Co—Al—Fe (EPA No. 106948). The present inventors have also filed applications, i.e., application 773,547, filed in 1985 and application 843,286, filed in 1986. However, the addition of Co brings about a deterioration in the magnetic characteristics so that a demand is strong for improving the performance of the rare earth-Fe-based permanent magnet, with development efforts under way at various laboratories.

SUMMARY OF THE INVENTION

An object of the present invention is to provide a rare earth-Fe-based permanent magnet which has high $(BH)_{max}$.

Another object of the present invention is to provide a rare earth-Fe-based permanent magnet which has high coercive force (iHc).

The permanent magnet of the present invention consists of an alloy that has largest amount of iron and includes boron and material R (consisting of at least one element from the group of rare earth element and yttrium), and said alloy further includes gallium.

More specifically, a permanent magnet of the present invention consists essentially of 10–40% by weight of material R consisting of at least one element from the group of yttrium and rare-earth elements, 0.1–8% by weight of boron, gallium and iron. The gallium comprises no more than 13% by weight of the permanent magnet. If necessary, Co may be added up to 30% by weight. This magnet may be produced by the sintering method, liquid quenching method, and the like.

DETAILED DESCRIPTION OF THE PREFERRED EMBODIMENTS

The present invention will now be described in detail.

A permanent magnet according to the present invention contains 10 to 40% by weight of material R where R is at least one component selected from yttrium and rare-earth elements. In general, the coercive force iHc tends to decrease at high temperatures. When the content of R is less than 10%, the coercive force iHc is low and satisfactory magnetic characteristics as a permanent magnet cannot be obtained. However, when the content of R exceeds 40%, the residual magnetic flux density Br decreases. The maximum energy product $(BH)_{max}$ is a value related to a product of the coercive force iHc and the residual magnetic flux density Br. Therefore, when either the coercive force iHc or residual magnetic flux density Br is low, the maximum energy product $(BH)_{max}$ is low. For these reasons, the content of R must be 10 to 40% by weight.

Among rare-earth elements, neodymium (Nd) and praseodymium (Pr) are particularly effective in increasing the maximum energy product $(BH)_{max}$. In other words, Nd and Pr serve to improve both the residual magnetic flux density Br and the coercive force iHc. Therefore, material R preferably includes at least one of Nd and Pr. In this case, the content of Nd and/or Pr based on the total content of R is preferably 70% by weight or more.

Boron (B) serves to increase the coercive force iHc. When the B content is less than 0.1% by weight, the coercive force iHc cannot be satisfactorily increased. However, when the B content exceeds 8% by weight, the residual magnetic flux density Br is decreased too much. For these reasons, the B content is set to fall within the range of 0.1 to 8% by weight. In obtaining permanent magnets of high coercive force type, it is preferable to have a B content of greater than 1.25% by weight.

Further, although a part of B may be substituted by C, N, Si, P, Ge, and others to improve the sintering characteristics and the like, the substituted amount should be up to 80% by weight of the amount of B.

Figure 1:
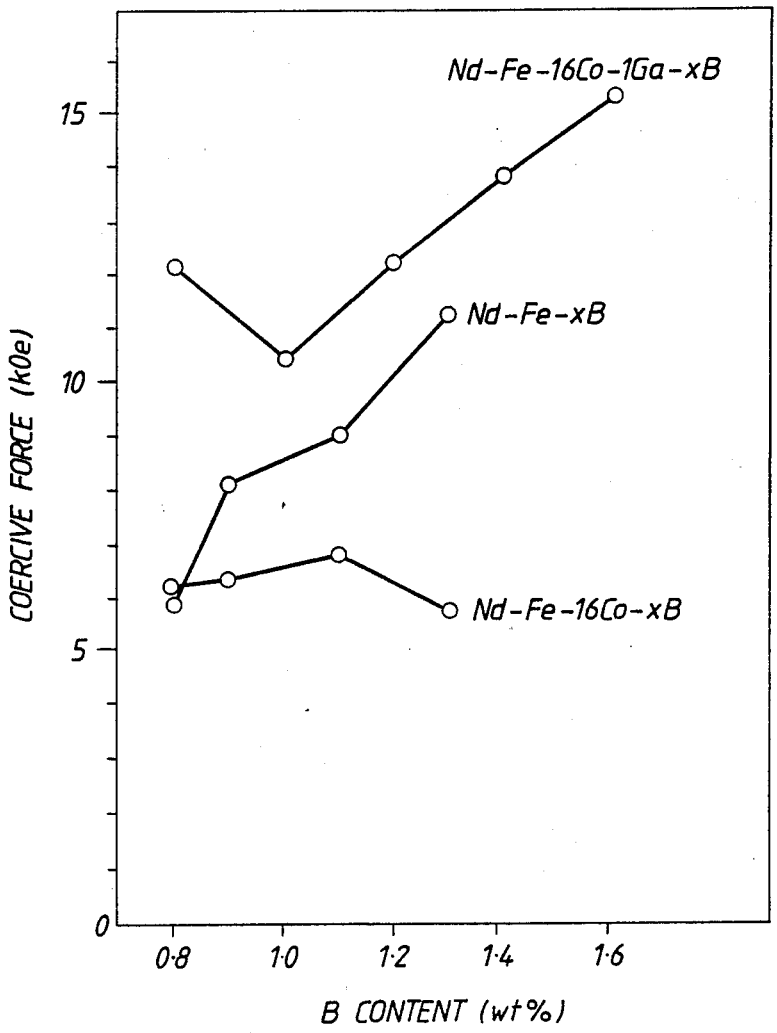
FIG. 1 and FIG. 2 are diagrams for showing the dependence of magnetic characteristics on the B content.
Figure 2:
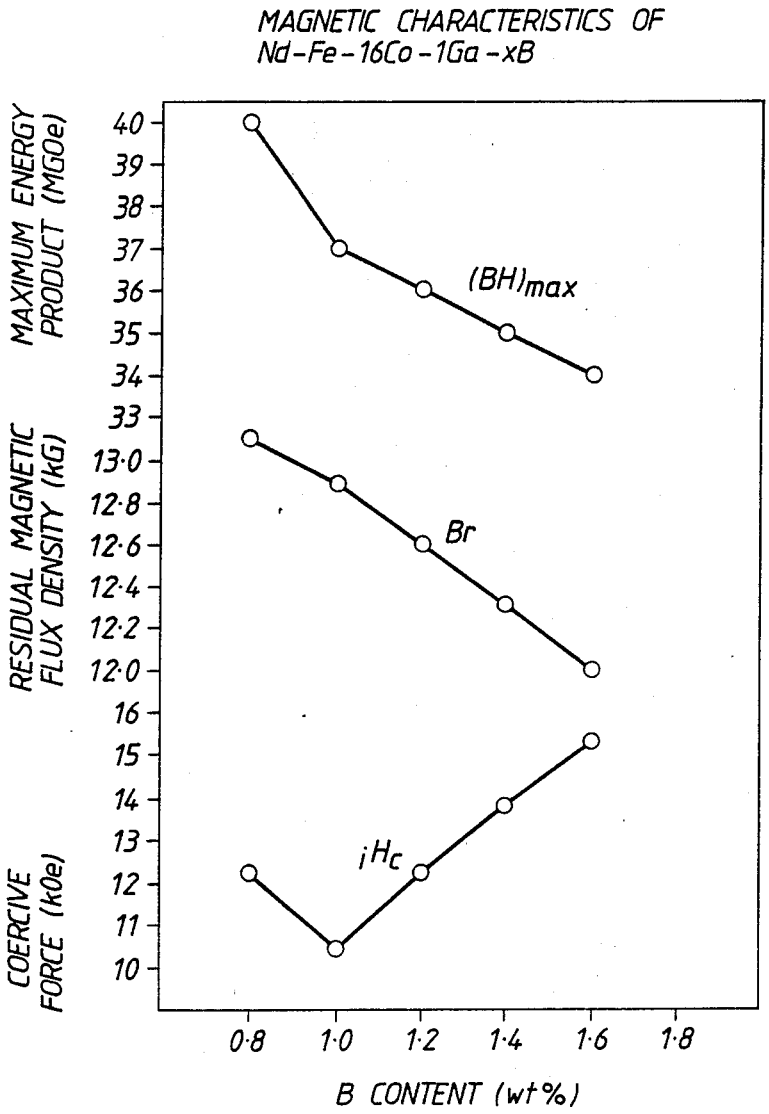

Gallium (Ga) is an element which is effective for improving the magnetic characteristics such as iHC. Even an addition of a small amount of the element can prove to be effective (see FIG. 1 and FIG. 2). In practice, the content of Ga is 0.1% by weight or more, and preferably more than 0.2% by weight or more is desired. Addition of an excessive amount of Ga leads to a conspicuous reduction in the value of Br so that the content should be restricted to less than 13% by weight. It should be mentioned that up to 90% by weight of Ga content may be replaced by Al.

The remainder is substantially iron (Fe), but the presence of inevitable impurities such as oxygen (O) may be tolerated to the extent they do not affect the properties of the present invention.

In addition, it is also effective to age the magnet at a temperature in the range of 550° to 1,200° C. prior to aging at a temperature in the range of 550° to 750° C. Further, in performing such a two-stage aging, the aging of the second stage may be carried out at a temperature in the range of 500° to 750° C. If the first stage aging is at a temperature outside of the temperature range given above, the rectangular moldability is reduced, and if the second stage aging is at a temperature outside of the above range of temperature, there occurs a reduction in coercive force.

The magnet according to the present invention basically consists of R, Fe, B and Ga. However, the magnet of the present invention can additionally contain cobalt (Co), chromium (Cr), aluminum (Al), titanium (Ti), zirconium (Zr), hafnium (Hf), niobium (Nb), tantalum (Ta), vanadium (V), manganese (Mn), molybdenum (Mo), tungsten (W), etc. These components may be added in a total amount of 30% by weight or less. Co serves to increase the Curie temperature of the alloy and improve the stability of magnetic characteristics against temperature change. The content of cobalt is preferably 30% be weight or less. In practice, the content of Co is 1% by weight or more. When the total amount of such components exceeds 30% by weight, the Fe content is decreased accordingly, and the residual magnetic flux density of the alloy is decreased. As a result, the maximum energy product $(BH)_{max}$ is decreased. The content of cobalt is more preferably 10–20% by weight.

A permanent magnet in accordance with the present invention may be manufactured, for example, as follows. First, a permanent magnetic alloy with the prescribed composition is prepared and crushed by a crushing means such as a ball mill. To facilitate formation and sintering in the subsequent processes and to provide the product with satisfactory magnetic characteristics, it is desirable to crush it finely to powders with mean particle diameter of 2 to 10 μm. If the particle diameter is too large, it leads to a reduction in the coercive force. On the other hand, if it is too small, crushing becomes difficult and will result in a deterioration of magnetic characteristics such as Br.

The powder obtained in this manner is compressed in a predetermined shape. In this process, as in a conventional process of manufacturing a normal sintered magnet, a magnetic field of about 15 kOe is applied to obtain a predetermined magnetic orientation. The powdered compacted material is sintered at 1,000° to 1,200° C. for 0.5 to 5 hours to obtain a sintered body. In the sintering process, in order not to increase the oxygen concentration in the alloy, the compacted material is heated in an inert gas atmosphere such as Ar gas or in a vacuum (not more than $10^{-3}$ Torr)

The resultant sintered body is aged at 550° to 750° C. for 1 to 10 hours, thereby improving the magnetic characteristics such as iHc and the rectangular moldability of the magnet.

In addition, it is also effective to age at a temperature in the range of 550° to 1,200° C. prior to aging at a temperature in the range of 550° to 750° C. Further, in performing such a two-stage aging, the aging of the second stage may be carried out at a temperature in the range of 500° to 750° C. If the first stage aging is carried out at a temperature outside of the temperature range given above, the rectangular moldability is reduced, and if the second stage aging is carried out at a temperature outside of the above range of temperature, there occurs a reduction in coercive force.

A permanent magnet prepared in this manner has a high coercive force iHc and residual magnetic flux density Br and therefore has a high maximum energy product $(BH)_{max}$. Thus, the permanent magnet of the present invention has excellent magnetic characteristics.

In employing such a sintering method, the content of oxygen in the permanent magnet alloy has an important significance. Since large amount of oxygen leads to a decrease in the coercive force, it becomes impossible to obtain a large value of $(BH)_{max}$. Therefore, it is preferred to include less than 0.03% by weight. Moreover, if the content is too small, pulverization which is required to be done to a fine particle size of about 2 to 10 μm, becomes difficult, and moreover, there will arise a nonuniformity in the particle diameter. Accordingly, it leads to a decrease in the value of Br that accompanies a reduction in the orientability during the formation in a magnetic field, which eventually leads also to a lowering in the value of $(BH)_{max}$. For these reasons, it is desirable to choose the content of oxygen in the range of 0.005 to 0.03% by weight.

Although the role of oxygen in the alloy is not elucidated yet, it may be considered that a high performance permanent magnet is obtained for the reasons described below. Namely, a part of the oxygen in the molten alloy is combined with R and Fe atoms that represent the major constituents, to form oxides. These oxides are considered segregated and exist in the grain boundaries and are absorbed especially by the R-rich phase to hamper the magnetic characteristics. The rare earth-Fe-based permanent magnet consists of corpuscle magnets and its coercive force is determined by the magnetic field that generates reversed magnetic domains. It may be that when many defects such as oxides and segregations exist, the coercive force will be decreased by the action of these defects as the generating sources of the reversed magnetic domains. However, when there are too few defects, boundary breakdown or the like does not easily occur and it is considered that the pulverization characteristics will be deteriorated. The oxygen content in the alloy for permanent magnet can be controlled by the use of highly pure raw materials and by a strict control of the oxygen content in the molten raw material alloy in the furnace.

The sintered permanent magnet of an R—B—Fe system has a ferromagnetic Fe-rich phase of a tetragonal system of $Nd_2Fe_{14}B$ type as the principal phase. It may also include a nonmagnetic R-rich phase of a cubic system such as $Nd_{97}$ Fe or $Nd_{95}Fe_5$ that has more than 90% by weight of the R component, a nonmagnetic B-rich phase of a cubic system such as $Nd_{1+\epsilon}Fe_4B_4$ (where $\epsilon$ is approximately 0.1), and others as the constituent phases, in addition to including some oxides. The composition is similar when an R component other than Nd is used.

Incidentally, although the state in which gallium exists in the magnet is not known in detail, it is principally concentrated in the R-rich phase.

Now, a magnet of the present invention can be manufactured by methods other than the sintering method.

Namely, one of such methods includes a first process of obtaining thin ribbons or powder consisting of a permanent magnetic alloy by the liquid quenching method. Then these thin ribbons of powder are united into a desired shape by either heating, or crushing them to a size of about 10 to 100 μm, mixing and tempering with a binder such as resin, and molding and solidifying in a magnetic field or with no magnetic field.

The permanent magnetic alloy contains as the principal constituents at least one material selected from yttrium and the rare-earth metals such as Ce, Pr and Nd (it may be a mischmetal (M.M.) which contains more than one of the rare-earth elements), and iron. In addition, it contains B for stabilization. The method of manufacturing the alloy is similar to the case of manufacture by sintering. However, in the case of liquid quenching method the ranges of composition become wider than in the case of sintering. For example, it is as shown below:

$$R_{1-\alpha-\beta-\gamma-\delta}B_\alpha Fe_\beta Co_\gamma Ga_\delta$$

$$0.001 \leqq \alpha \leqq 0.5$$

$$0.5 < \beta \leqq 0.95$$

$$0 \leqq \gamma \leqq 0.3$$

$$0 < \delta \leqq 0.1$$

$$\alpha+\beta+\gamma+\delta < 1.0 \ (\alpha, \beta, \gamma, \delta; \text{atomic ratio})$$

If $\alpha<0.001$, $\beta>0.95$, and $\gamma>0.3$, the product is inadequate as a permanent magnetic alloy due to insufficient improvement in the coercive force. On the other hand, if $\alpha>0.5$ and $\beta<0.5$, the product is again inadequate as a permanent magnetic alloy due to a reduction of the magnetic flux density.

It may be noted that a part of Ga may be replaced by Al and Ti.

When such a permanent magnetic alloy is made into a thin ribbon by the liquid quenching method, the C axis is oriented under certain cooling conditions in the direction perpendicular to the thin ribbon. This is a phenomenon which can not be observed in the Sm - Co system. In manufacturing such an alloy, a method similar to the manufacture of amorphous alloys is employed. Namely, a thin ribbon is formed by ejecting liquid of an alloy onto a rotating roll which is being kept cool.

In that case, if the speed of rotation of the roll cooler is too large, the thin ribbon becomes noncrystalline without orientation so that it will not work as a permanent magnet. On the other hand, if the speed of rotation is too slow, the product will be crystalline. However, the crystal grains have an inferior orientability so that the resulting magnetic characteristics are unsatisfactory. In view of these circumstances, the surface speed of the roll is desirably within the range of 3 to 20 m/sec.

A magnet may be made from crystalline thin ribbons obtained in the above manner according to the following methods. A first method is to laminate crystalline thin ribbons so as to form a desired shape, and unite them by heating. Although the temperature of heating differs depending upon the composition, a temperature above 600° C. is required for bringing them into a united body, and a temperature below 1,100° C. is preferred for preventing crystallization from liquid phase. The heating occurs for 0.1 to 5 hours.

In addition, it is preferable to apply pressure in the range of 0.1 to 2 ton/cm$^2$, during unification in order to obtain a large energy product.

The second method is as follows. The alloy is coarsely crushed by a jaw crusher, and further is made into a powder with average particle diameter of 5 to 30 μm by means of a jet mill or the like. A surface treatment is given to the magnetic powders by the use of silane-based coupling agent or the like in order to prevent oxidation of the magnetic powders as well as to improve the coupling with a thermoplastic resin.

Following the above treatment, the magnetic powder which went through the surface treatment and the thermoplastic resin are brought together, and are mixed thoroughly in a mortar or in a tempering machine of a stirring type. The mixing ratio in this case of the resin to the magnetic powder is 3 to 10% by weight, and preferably 6 to 10% by weight. This is because the deterioration in the mechanical properties of the magnetic powder is conspicuous if the ratio is less than 3% by weight, whereas if the ratio exceeds 10% by weight there begins to appear deterioration of magnetic properties. Here, various kinds of thermoplastic resins may be used such as those of the polyamide series like nylon 6 and nylon 66 those of the polyolefine series like ethylene, polypropylene, vinyl chloride, and polyester.

Then, a permanent magnet is manufactured by holding the above mixture of powder by heating and applying magnetic field by the projection molding method. In this process, the heating temperature is in the range of 230° to 300° C., the applied pressure is in the range 0.3 to 2 ton/cm$^2$, and the applied magnetic field is greater than 15 kOe. If the heating temperature is below 230° C., the fluidity of the mixed powders is unsatisfactory and the mixing of the magnetic powders and the resin is insufficient, resulting in an increased nonuniformity of the molded body as well as a deterioration in the magnetic characteristics. On the other hand, if the heating temperature exceeds 300° C., gasses are generated by the decomposition of the resin which produces unsatisfactory magnet characteristics due to the interposition of bubbles and the like.

EXAMPLE 1

A mixture of element in the desired composition was melted by arc in a watercooled copper boat in an Ar atmosphere. The magnetic alloy obtained (oxygen concentration of 0.02 wt %) was coarsely crushed in an Ar atmosphere, and was pulverized further to the grain size of about 3 μm in a jet mill.

A mold was filled with the pulverized powder, and the powder was formed under a pressure of 2 ton/cm$^2$ while applying a magnetic field of 20 kOe. After sintering the formed body in Ar atmosphere for one hour at 1020° to 1120° C. and rapid cooling to room temperature, the result was aged for 3–10 hours at 550°–750° C., and was then cooled rapidly to room temperature.

The characteristics for magnets with various compositions manufactured in a similar manner are presented in the following Table 1. All of these permanent magnets obtained by the present invention show excellent characteristics.

TABLE 1

| Composition (wt %) | Characteristics of Magnet iHc(kOe) | Br(kG) | $(BH)_{max}$ (mGoe) |
|---|---|---|---|
| 31.1 Nd - 1.4 B - 1.0 Ga - bal Fe | 14.3 | 12.3 | 35.7 |
| 30.6 Nd - 0.9 B - 1.1 Ga - bal Fe | 12.3 | 13.2 | 41.2 |
| 31.8 Nd - 1.3 B - 2.2 Ga - bal Fe | 13.9 | 12.2 | 35.0 |
| 32.2 Nd - 1.6 B - 1.1 Ga - bal Fe | 14.6 | 12.0 | 34.2 |
| 31.0 Nd - 1.0 B - 3.1 Ga - bal Fe | 14.1 | 12.3 | 35.1 |
| 31.3 Nd - 0.9 B - 14.1 Co - 1.0 Ga - bal Fe | 12.2 | 13.1 | 40.4 |
| 31.9 Nd - 1.4 B - 14.4 Co - 1.1 Ga - bal Fe | 13.8 | 12.3 | 35.4 |
| 32.2 Nd - 1.6 B - 14.5 Co - 1.1 Ga - bal Fe | 15.3 | 12.0 | 34.0 |
| 31.0 Nd - 0.8 B - 14.1 Co - 3.0 Ga - bal Fe | 16.1 | 12.8 | 38.5 |
| 29.9 Nd - 0.9 B - 14.3 Co - 1.0 Ga - 1.0 Al - bal Fe | 12.9 | 12.9 | 39.2 |
| 32.2 Nd - 1.4 B - 14.2 Co - 1.0 Ga - 0.8 Al - bal Fe | 15.1 | 12.1 | 34.3 |
| 29.7 Nd - 1.1 Pr - 0.9 B - 16.1 Co - 1.1 Ga - bal Fe | 13.6 | 12.7 | 37.7 |
| 30.0 Nd - 1.1 Dy - 0.83 B - 15.5 Co - 2.0 Ga - bal Fe | 17.3 | 12.0 | 34.1 |
| 29.1 Nc - 1.4 Dy - 1.4 B - 1.0 Ga - bal Fe | 19.1 | 11.6 | 31.6 |

EXAMPLE 2

Elements were blended to form a composition of 30.8% by weight of neodymium, 0.86% of weight of boron, 1.0% by weight of gallium, and the balance of iron. Two kilograms of the mixture were melted by arc in a water-cooled copper boat under an argon atmosphere. In the process, by strictly controlling the amount of oxygen in the furnace, the oxygen content in the prepared alloy was adjusted. Then the alloy was finely pulverized by a stainless steel ball mill to an average particle size of 3 to 5 μm. The resultant fine powder was packed in a predetermined press mold and compressed at a pressure of 2 ton/cm$^2$ while applying a magnetic field of 20,000 Oe. The resulting body was sintered in an Ar gas atmosphere at 1,080° C. for 1 hour. Then, the sintered body was cooled to room temperature and was aged in a vacuum at 600° C. for 5 hours. The sintered body was then rapidly cooled to room temperature.

Figure 3:
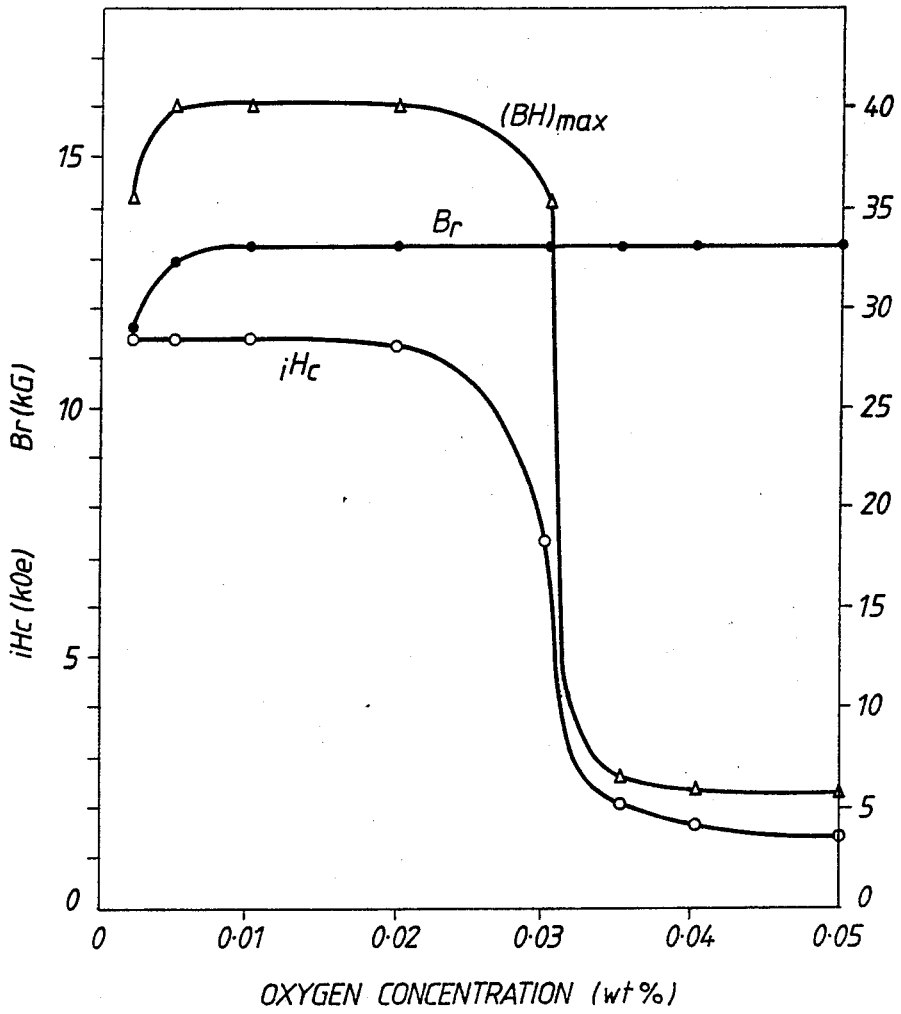
FIG. 3 is a diagram for showing the dependence of magnetic characteristics on the O content.

FIG. 3 shows the residual magnetic flux density Br, the coercive force iHc, and the maximum energy product $(BH)_{max}$ as a function of oxygen concentration in the permanent magnetic alloys.

As can be seen from FIG. 3, the magnetic characteristics of the permanent magnet largely depend on the oxygen concentration in the alloy. Thus, when the oxygen concentration is less than 0.005% by weight, orientation performance in a magnetic field is impaired. Thus, the residual magnetic flux density Br is also decreased. However, when the oxygen concentration exceeds 0.003% by weight, the coercive force is significantly decreased. Therefore, in a composition wherein the oxygen concentration is less than 0.005% by weight or more than 0.03% by weight, a high maximum energy product $(BH)_{max}$ cannot be obtained.

EXAMPLE 3

By a method analogous to that of Example 2, there was obtained a permanent magnetic alloy which has a composition of 31.0% by weight of neodymium, 0.84% by weight of boron, 14.6% by weight of cobalt, 1.1% by weight of gallium, 0.03% by weight of oxygen, and the balance of iron.

Using the permanent magnetic alloy obtained, a permanent magnet was manufactured by pulverizing, molding under compression, and sintering in a manner analogous to Example 1.

After sintered specimens were aged for 1 hour at various temperatures in the range of 300° to 900° C. and were quenched, their coercive force was examined. The results are shown in FIG. 4.

Figure 4:
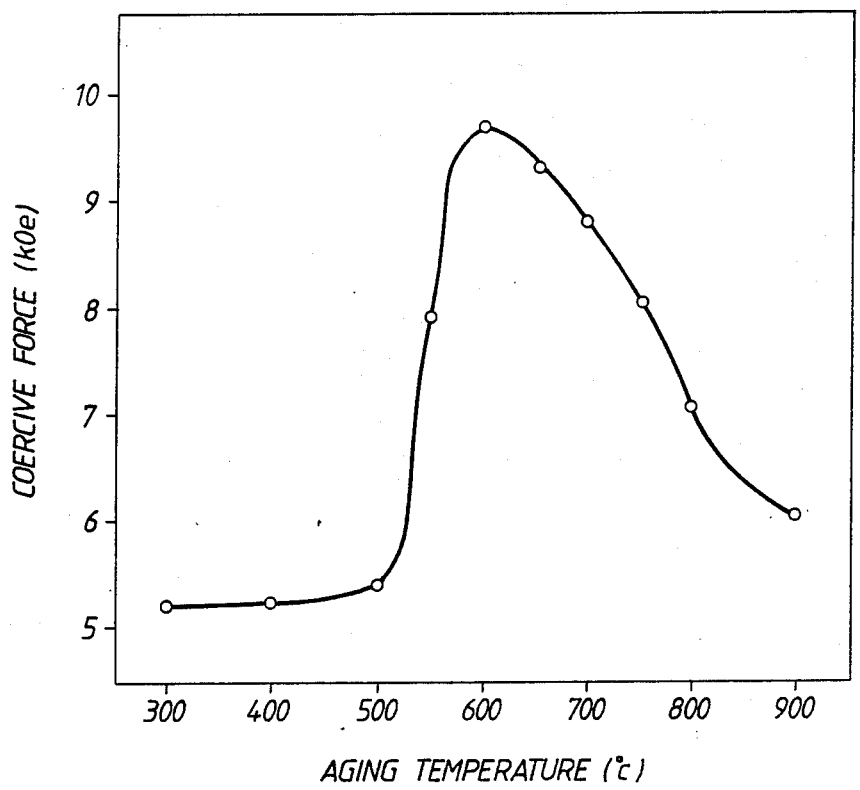
FIG. 4 is a diagram for showing the dependence of a magnetic characteristic on the aging temperature.

As may be clear from FIG. 4, the aging temperature affects the coercive force sharply, and an optimum characteristic was obtained for the temperature range of 500° to 750° C.

EXAMPLE 4-1

A permanent magnet alloy consisting of 31.3% by weight of neodymium, 0.9% by weight of boron, 14.1% by weight of cobalt, 1.0% by weight of gallium, 0.02% by weight of oxygen, and the balance of iron, was prepared by arc fusion in an argon atmosphere.

The permanent magnet alloy obtained was coarsely crushed in an argon atmosphere, and then was finely pulverized in a jet mill under a nitrogen atmosphere to an average particle diameter of 3 μm.

The fine powder was placed in a predetermined mold, and a molded body was contained by compressing the powder with a pressure of 2 ton/cm$^2$, while applying a magnetic field of 20,000 Oe. The obtained molded was sintered in vacuum for 1 hour at the temperature of 1,080° C., and was then quenched to room temperature. Following that, a first stage aging was performed in a vacuum for 1 hour at 900° C., and then was quenched to room temperature. The molded body was heated again in a vacuum to 600° C. for 3 hours as a second aging stage, and then was quenched to room temperature. This specimen was designated as sample 1.

Another magnet was manufactured by a method analogous to that of sample 1, except for giving an aging treatment which consists only of heating at 900° C. for 1 hour. This specimen was designated as sample 2.

Still another magnet was prepared by a method which is analogous to that of sample 1, except that the first stage aging was performed at 600° C. for 3 hours and was then quenched to room temperature. This specimen was designated as sample 3.

Figure 5:
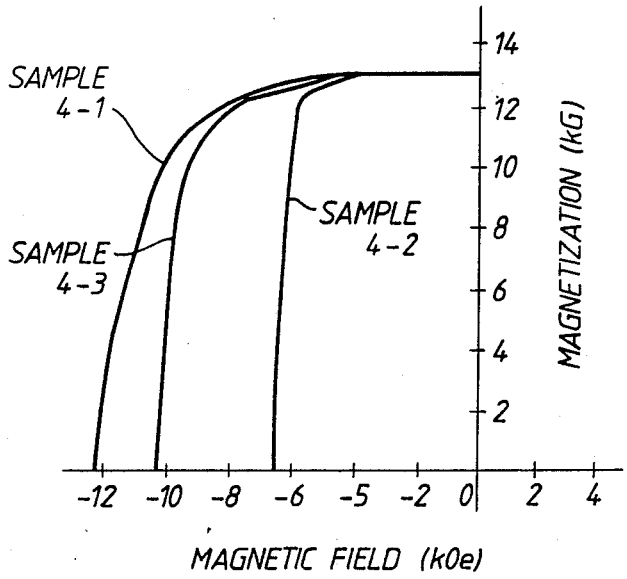
FIG. 5 is a diagram for showing demagnetization curves.

The magnetization curve was measured for each of these samples. The form of the demagnetization curve is shown in FIG. 5, and the values for the magnetic flux density, the coercive force, and the maximum energy product are shown in Table 2.

TABLE 2

| Sample No. | Magnetic Flux Density (KG) | Coercive Force (kOe) | Energy Produce (mGOe) |
|---|---|---|---|
| 4-1 | 13.2 | 12.4 | 42.0 |
| 4-2 | 13.2 | 6.6 | 39.5 |
| 4-3 | 13.2 | 10.5 | 40.4 |

EXAMPLE 4-2

TABLE 4

| Composition (weight %) | Sample 1 iHc(kOe) | BR (kG) | (BH)max (mGOe) | SAMPLE II iHc(bOe) | (Br(kG) | (BH)max (mGOe) | iHc(kOe) | Br(kG) | (BH)max (mGOe) |
|---|---|---|---|---|---|---|---|---|---|
| 31.3Nd-14.1Co-0.88B-1.0GA-Fe bal | 5.2 | 13.1 | 38.6 | 12.2 | 13.1 | 40.4 | 12.7 | 13.1 | 40.4 |
| 32.2Nd-14.5Co 1.6B-1.1Ga-Fe bal | 6.3 | 12.0 | 33.6 | 15.3 | 12.0 | 34.0 | 15.7 | 12.0 | 34.0 |
| 31.9Nd-14.4Co-1.4B-1.1Ga-Fe bal | 4.2 | 12.3 | 32.3 | 13.8 | 12.3 | 35.4 | 14.4 | 12.3 | 35.4 |
| 31.7Nd-14.3Co-1.4B-0.5Ga-0.3Al-Fe bal | 4.8 | 12.3 | 34.0 | 13.6 | 12.3 | 35.7 | 14.1 | 12.3 | 35.7 |
| 20.7Nd-1.1Pr-16.1Co-0.87B-1.11Ga-Fe bal | 5.1 | 12.7 | 36.2 | 13.6 | 12.7 | 37.7 | 14.1 | 12.7 | 38.1 |
| 30.0Nd-1.1Dy-15.5Co-0.83B-1.12Ga-Fe bal | 5.8 | 12.0 | 33.2 | 17.3 | 12.0 | 34.1 | 18.3 | 12.0 | 34.1 |

Magnets with compositions as shown in Table 3 were obtained by a method analogous to that of Example 4-1. Sintering for the magnet was carried out in argon atmosphere at a temperature in the range of 1,020° to 1,120° C. for 1 hour. After sintering and quenching to room temperature, the magnet was aged in a vacuum at 900° C. for 1 hour. Following that, the magnet was again aged at 600° C. for 3 to 10 hours, and then was quenched to room temperature.

The characteristics of the permanent magnet obtained are also shown in Table 3.

TABLE 3

| Composition (wt %) | Br (kG) | iHc (kOe) | (BH)max (mGOe) |
|---|---|---|---|
| 30.8Nd - 14.5Co-1.6B - 1.1Ga - Fe bal | 12.2 | 15.8 | 34.6 |
| 31.3Nd - 14.1Co - 0.8B - 1.0Ga - 0.4Al - Fe bal | 12.8 | 12.3 | 38.6 |
| 30.9Nd - 14.5Co - 1.4B - 1.1Ga - 0.6Al - Fe bal | 12.4 | 14.2 | 35.5 |
| 30.8Nd - 0.86B - 1.0Ga - Fe bal | 13.1 | 12.6 | 40.8 |
| 32.3Nd - 1.2B - 0.5Ga - 0.3Al - Fe bal | 12.6 | 13.3 | 37.7 |

EXAMPLE 4-3

Magnets with compositions as shown in Table 4 were obtained by a method analogous to that of Example 4-1. The sintering for the magnet was carried out in vacuum at a temperature in the range of 1,020° to 1,120° C. for 1 hour. SAMPLES I, II, and III in Table 4 were obtained in the following manner.

I After sintering, the magnet was quenched to room temperature.

II After sintering and quenching to room temperature, the magnet was aged at 600° C. for 3 to 10 hours.

III After sintering and quenching to room temperature, the magnet was aged at 900° C. for 1 hour, followed by a second stage aging treatment of 600° C. for 3 to 7 hours.

Results of measurement on magnetic characteristics are shown in Table 4. As may be clear from Table 4, the coercive force and the maximum energy product are improved sharply by a single stage aging treatment or a two-stage aging treatment.

EXAMPLE 5-1

Figure 6:
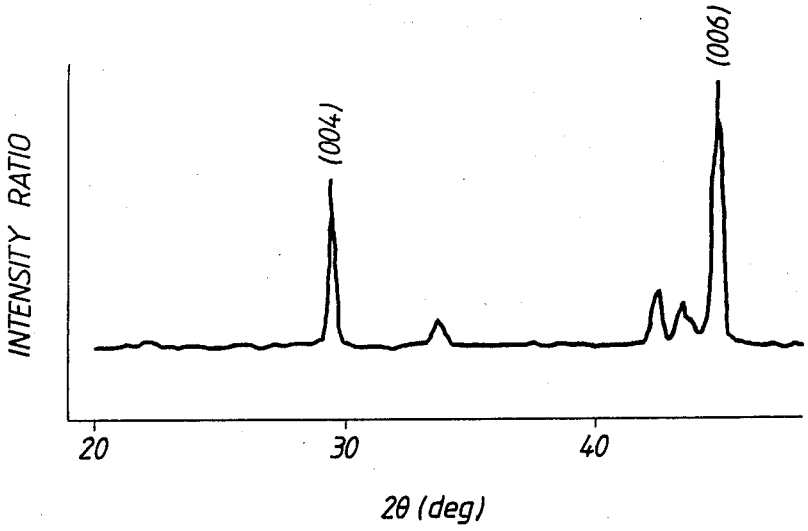
FIG. 6 and FIG. 7 are X-ray diffraction diagrams.
Figure 7:
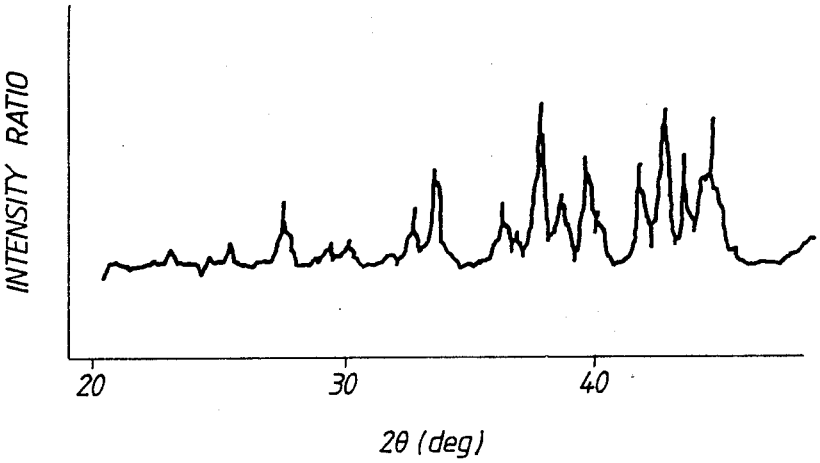

Using the liquid quenching method, a ribbon was obtained from an alloy that has a composition of Nd 0.17, B 0.06, Fe 0.59, Co 0.16, and Ga 0.02 (in atm % ratio for each). Namely, a crystalline thin ribbon of 10 mm width and 100 μm thickness was obtained by ejecting and cooling liquid alloy via a quartz nozzle by means of the pressure of argon gas, on the surface of a roll which is rotated at a speed of about 10 m/sec. The result of measurements on the thin ribbon obtained, by means of an X-ray diffraction apparatus, is shown in FIG. 6. In addition, the result of an X-ray diffraction measurement on an alloy powder material is shown in FIG. 7 for comparison.

From the above results, it will be seen that a C-axis is oriented in the direction perpendicular to the ribbon surface, in the case of the thin ribbon obtained by liquid quenching method compared with the alloy powder material.

A thin ribbon obtained by the liquid quenching method was cut in strips with length of 10 mm. One hundred pieces of the strip were laminated, and a heat treatment at 700° C. for 10 minutes was given while a pressurized molding with a pressure of 2 ton/cm$^2$ was proceeding. The magnetic characteristics of the magnet obtained are shown in Table 5.

TABLE 5

| Example | Composition (atomic ratio) | Residual Magnetization (Br) (G) | Coercive Force (iHc) (Oe) | Energy Pro ((BH)max) (mGOe) |
|---|---|---|---|---|
| 5-1 | Nd0.17, B0.06, Fe0.59 Co0.16, Ga0.02 | 12880 | 12500 | 39 |
| 5-2 | Nd0.10, Pr0.08, B0.10 Fe0.56, Co0.14, Ga0.01 A10.01 | 11600 | 13200 | 32 |
| 5-3 | Nd0.15, B0.06, Fe0.61 Co0.16, Ga0.02 | 12400 | 14000 | 35 |
| 5-4 | Nd0.15, B0.08, Fe0.59 Co0.16, Ga0.01, Ti0.01 | 11900 | 12100 | 34 |

EXAMPLE 5-2

A thin ribbon of magnet alloy with a composition of Nd 0.10, Pr 0.08, B 0.10, Fe 0.56, Co 0.14, Ga 0.01, and Al 0.01 (atm % for each) was prepared. After lamination of the thin ribbon in the form of flakes as they are, a heat treatment at 680° C. for 10 minutes was given while being molded with a pressure of 2 ton/cm$^2$. The magnetic characteristics of the magnet obtained are shown in Table 5.

EXAMPLE 5-3

A thin ribbon of magnet alloy with a composition of Nd 0.15, B 0.06, Fe 0.61, Co 0.16, and Ga 0.02 (atm ration for each) was prepared. Strips of the thin ribbon were laminated analogously to Example 5-1 and a heat treatment at 710° C. for 20 minutes was given while being molded under a pressure of 2 ton/cm$^2$. The magnetic characteristics of the magnet obtained are shown in Table 5.

EXAMPLE 5-4

A thin ribbon of magnetic alloy with a composition of Nd 0.15, B 0.08, Fe 0.59, Co 0.16, Ga 0.01, and Ti 0.01 (atm ration for each) was prepared. Strips of the thin ribbon were laminated analogously to Example 5-1 and a heat treatment at 700° C. for 10 minutes was given while being molded under a pressure of 2 ton/cm$^2$. The magnetic characteristics of the magnet obtained are shown in Table 5.

As many may be clear from Table 5, it was possible to obtain magnets with satisfactory values of the coercive force (iHc) and the energy product ($(BH)_{max}$) by the use of the liquid quenching method. This is believed to be caused by the absence of impurities due to the absence of crushing, and the effect of the laminated heating treatment. Moreover, manufacture of magnets can be simplified due to omission of such processes as pulverization and pressing in a magnetic field that are required in the exist method of powder sintering.

EXAMPLE 5-5

The thin ribbons obtained in Examples 5-1 to 5-4 by the liquid quenching method were pulverized in a ball mill to the average particle diameter of 30 μm.

After coating the powder of each magnet with a silane-based coupling agent, 6% by weight of nylon was added. Then, using each of these mixtures a permanent magnet was manufactured by injection molding under the conditions of 2 ton/cm$^2$, and an applied magnetic field of 15 kOe. The results of measurements of the magnetic characteristics of these permanent magnets are summarized in Table 6.

TABLE 6

| | Characteristics of Magnet | | |
|---|---|---|---|
| Composition | Br(G) | iHc(Oe) | (BH)max(mGOe) |
| Same as Example 5-1 | 8300 | 12400 | 16.3 |
| Same as Example 5-2 | 7100 | 13100 | 12.6 |
| Same as Example 5-3 | 7700 | 13800 | 14.5 |
| Same as Example 5-4 | 7200 | 11900 | 12.6 |

As may be clear from Table 6, it was possible to manufacture easily ejection molded magnets which possess a characteristic that exceeds 10 MGOe by the use of the liquid quenching method.

Although a number of exemplary embodiments are described in detail above, those skilled in the art will appreciate that many modifications are possible in the preferred embodiments without materially departing from the novel teachings and advantages of this invention. Accordingly all such modifications are intended to be included within the scope of this invention as defined by the following claims.

What the claim is:

1. A permanent magnet consisting essentially of a sintered of 10–40% by weight of material R consisting of at least one element from the group consisting of yttrium and rare-earth elements and wherein at least 90% by atom of material R consists, of neodymium, 0.1–8% by weight of boron and, 0.1–13% by weight of gallium and the balance of iron.

2. A permanent magnet according to claim 1, wherein the content of boron is more than 1.25% by weight.

3. A permanent magnet according to claim 1, wherein up to 90% by weight of gallium is replaced by aluminum.

4. A permanent magnet according to claim 1, wherein the content of neodymium and praseodymium is 70% by weight or more of the material R.

5. A permanent magnet according to claim 1, wherein the sintered body further consists of 30% by weight of less of cobalt.

6. A permanent magnet according to claim 5, wherein the content of cobalt is 1–30% by weight.

7. A permanent magnet manufactured by a process, comprising the steps of:

melting a raw material consisting essentially of 10–40% by weight of material R consisting of at least one element from the group consisting of yttrium and rare-earth elements, and wherein at least 90% by atom of material R consists of neodymium 0.1–8% by weight of boron 0.1–13% by weight of gallium, 0.005–0.03% by weight of oxygen and the balance of iron;

casting a melt of the raw material to obtain a block;

pulverizing the block to a powder having an average particle size of 2 to 10 μm;

compressing the powder while applying a magnetic field to obtain a compacted material; and sintering the compacted material at a temperature of 1,000° to 1,200° C. for 0.5 to 5 hours to obtain a sintered body.

8. A permanent magnet according to claim 7, wherein the raw material further includes not more than 30% by weight of cobalt.

9. A permanent magnet according to claim 7, wherein the raw material further includes 10 to 20% by weight of cobalt.

10. A permanent magnet according to claim 7, wherein the sintered body is aged at a temperature of 550° to 750° C. for 1 to 10 hours.

11. A permanent magnet according to claim 7, wherein the sintered body is aged at a temperature of 550° to 1200° C. and further aged at a temperature of 550° to 750° C.

* * * * *